United States Patent [19]

Wietsma

[11] 4,018,647

[45] Apr. 19, 1977

[54] PROCESS FOR THE IMPREGNATION OF A WET FIBER WEB WITH A HEAT SENSITIZED FOAMED LATEX BINDER

[75] Inventor: Popke Wietsma, Velp, Netherlands

[73] Assignee: Chemische Industrie AKU-Goodrick B.V., Arnhem, Netherlands

[22] Filed: June 10, 1974

[21] Appl. No.: 477,910

[30] Foreign Application Priority Data

June 18, 1973 Netherlands ..... 7308406

[52] U.S. Cl. ..... 162/168 R; 162/145; 162/146; 162/156; 162/157 R; 162/157 C; 162/168 N; 162/168 NA; 162/169; 162/186; 264/45.8; 427/246; 427/296; 427/287; 427/390 R; 427/390 A; 427/391; 427/392

[51] Int. Cl.² ..... D21D 3/00; D21F 11/02; D21H 3/40

[58] Field of Search ..... 162/164, 168, 169, 186, 162/181 C, 164 R, 164 EP, 168 R, 168 N, 168 NA, 145, 146, 156, 157 R, 157 C; 117/161 ZA, 161 UC, 161 UB; 156/78; 264/45.3, 45.8, 50; 260/448.2 R, 448.2 B; 427/296, 385, 387, 390, 391, 392, 381, 382, 246, 385 R, 385 B, 390 R, 390 A; 428/310, 313, 314

[56] References Cited

UNITED STATES PATENTS

| | | | |
|---|---|---|---|
| 3,013,924 | 12/1961 | Taft et al. | 156/78 |
| 3,025,202 | 3/1962 | Morgan et al. | 264/45.3 |
| 3,042,573 | 7/1962 | Roberts | 427/296 X |
| 3,255,140 | 6/1966 | Sinn et al. | 260/448.2 R X |
| 3,384,502 | 5/1968 | Japs | 427/246 |
| 3,436,303 | 4/1969 | Raymond et al. | 162/168 X |
| 3,483,240 | 12/1969 | Boudreau | 260/448.2 B |
| 3,484,394 | 12/1969 | Holdstock | 260/448.2 B X |
| 3,560,334 | 2/1971 | Arledter | 162/168 X |
| 3,748,217 | 7/1973 | May et al. | 156/78 X |
| 3,806 405 | 4/1974 | Heidweiller | 162/186 |

FOREIGN PATENTS OR APPLICATIONS

| | | |
|---|---|---|
| 1,221,093 | 7/1966 | Germany |

*Primary Examiner*—Arthur L. Corbin
*Attorney, Agent, or Firm*—Stevens, Davis, Miller & Mosher

[57] ABSTRACT

A fiber web made by the wet method on a paper making machine is impregnated with a heat sensitized, foamed latex binder as the web passes through a screening area of the paper making machine.

3 Claims, No Drawings

PROCESS FOR THE IMPREGNATION OF A WET FIBER WEB WITH A HEAT SENSITIZED FOAMED LATEX BINDER

The invention relates to a process for the manufacture of a fiber web impregnated with a foamed latex, which fiber web is obtained on a paper making machine by the wet method.

In the manufacture of a fiber web on a paper making machine by the wet method, in which an aqueous fiber suspension is formed into a web and subsequently dried, the fiber web is given the necessary coherence by means of a bonding agent. Prior to web formation, for instance, a dispersion of a synthetic material or rubber may be added to the fiber suspension and be caused to precipitate onto the fibers by means of a coagulating agent. The fiber web generally consists of shredded and nonshredded natural, synthetic or semi-synthetic fibers.

German Patent Specification No. 1,221,093 describes a process in which a bonding agent in the form of an aqueous foam is applied to a fiber web between the screening section and the first drying cylinder of the paper making machine. In order to obtain a smooth surface and sufficient strength it is still found necessary in practice to have the drying treatment followed by impregnating, spraying or printing the web with a dispersion of a synthetic material or rubber. The resulting products, however, have a paper-like hand, which is undesirable for a number of applications. Applicant has found moreover that the foamed latices proposed for the impregnation of fiber webs made by the dry method are less suitable for the impregnation of fiber webs made by the wet method. For during the drying of these wet webs the foamed latex destabilizes as a result of the large amounts of evolving water vapor and consequently loses its structure. The use then of foam stabilizers gives hardly any improvement. Besides, the drying process is attended with considerable migration of the impregnant, which is consequently very nonhomogeneously distributed in the fiber web.

Surprisingly, it has been found that the above drawbacks may be removed and fiber webs with a very soft and textile-like hand may be obtained if, according to the invention, the fiber webs are impregnated with a heat-sensitized foamed latex.

It is preferred that the heat-sensitized foamed latex be applied to the fiber web when the latter is on the screening part of the paper making machine. The foamed latex will then be sucked into the fiber web very simply by the sub-atmospheric pressure already available. In the drying section of the paper making machine coagulation of the latex and drying of the impregnated fiber web will subsequently take place.

The process according to the invention makes it possible to impregnate fiber webs of widely varying structure and thickness. For instance, fiber webs having a weight expressed as weight per square meter in the dry state of 10g or more may be impregnated, and also webs having a weight of 400g per square meter or higher; preferably webs with a weight of 50 to 120g per square meter are impregnated. The length of the fiber from which the fiber web is made does not have to remain within narrow limits. Fibers of any current length and thickness may be used, e.g. fibers having a length between 4 and 45 mm.

The process according to the invention may be applied to fiber webs made from very widely differing materials, for instance: rayon fibers, shredded or nonshredded cellulose, polyester fibers, polyamide fibers, polypropylene fibers, glass fibers and other current fibers suitable to be processed on the paper making machine, or mixtures of the above mentioned fibers. The use of fiber webs consisting entirely or partly of non-shredded cellulose may mean a considerable saving in cost.

The latex may in principle be any dispersion of a synthetic polymeric material obtained by the emulsion polymerisation of ethylenically unsaturated monomer(s), such as a latex of polyvinyl chloride or polyvinylidene chloride; a latex of a homopolymer or copolymer of diolefines with 4 to 8 carbon atoms, for instance: 1,3-butadiene, isoprene, 1,4-dimethylbutadiene-1,3 and 1,3-dimethylbutadiene-1,3 in combination, if desired, with another monomer such as styrene, methyl acrylate, ethyl acrylate, methyl methacrylate, ethyl methacrylate, acrylonitrile, N-methylol(meth)acrylamide or isobutene; a latex of a polymer or copolymer of one or more alkyl acrylates or alkyl methacrylates, in combination, if desired, with another monomer such as styrene, vinyl chloride or vinylidene chloride; and a latex of a polymer of chloroprene or a mixture of the above-mentioned latices.

The amount of impregnant to be applied in the process according to the invention depends, inter alia, on the nature of the fiber web and, hence, on the kind of fiber used, its staple length, thickness and structure and the desired properties of the bonded, impregnated and dried web such as the desired hand. The amounts used are generally in the range of 10 to 50% by weight of latex, calculated as dry matter on the dry web weight.

The foamed latex is heat-sensitized in a manner known per se by the addition of a heat-sensitizer thereto. As examples of known heat-sensitizers may be mentioned functional siloxane compounds such as e.g. siloxane oxyalkylene block copolymers and organopolysiloxanes. Specific examples of applicable heat-sensitizers and their use thereof for the heat sensitization of latices are described in the U.S. Pat. Nos. 3,255,140; 3,255,141; 3,483,240 and 3,484,394, which are incorporated herein by reference.

The amount of heat-sensitizer to be added is dependent, inter alia, on the type of latex used, the desired coagulation temperature, the machine speed and the temperatures in the drying section of the machine, and will generally be in the range of about 0.05 to about 3% by weight, calculated as dry matter on the dry weight of the latex; but also larger or smaller amounts may be used. The heat sensitizer should be added in such an amount that the latex will coagulate far below the boiling point of water, for instance at a temperature in the range of 35° to 95° C, preferably 35° to 65° C.

The fiber webs made by the process according to the invention are suitable for application in many different fields; for example they may be made into disposable sheets, garments, sanitary sheet material and into technical sheet material to be used as substrates for lamination products, e.g. synthetic leather. In the examples the breaking length of the web and the elongation at break is determined in conformity with TAPPI T220.

EXAMPLE 1

In a fiber slurry tank, a mixture of 50% non-shredded beech cellulose pulp and 50% rayon fiber having a staple length of 6 to 10 mm and a count of 1.5 denier is dispersed in water to a concentration of 0.03% and subsequently formed to a web on a screen belt. With the aid of a knife coated a layer of foam having a thickness of about 1 mm is spread on the web, which foam is sucked into the web by vacuum, after which the impregnated web is dried on a drying cylinder having a temperature of 120° C. Use is made of a self-reactive poly(ethyl acrylate) latex, which is frothed to a density of about 80g per liter. A functional siloxane compound having the formula $[CH_3Si\ O_3][(CH_3)_2\ Si\ O]_{20}$ $([C_2H_4O]_{4.3}[C_3H_6O]_3\ C_4H_9)_3$ is added as a gelling agent in an amount of 1% by weight, calculated as dry matter on the dry latex. The amount of impregnant is about 25g/100g of web weight. The web weight is 48g/m².

The breaking length of the dry web is 1460 meters; the elongation at break is 17%. After immersion in water of the impregnated web for 24 hours the values measured are 940 meters and 20%, respectively.

EXAMPLE 2

According to the procedure of Example 1 a fiber web comprising 50% eucalyptus cellulose and 50% rayon fiber having a staple length of 6 to 10 mm and a count of 1.7 denier is manufactured and impregnated with a foamed latex having a density of 100g per liter. Use is made of a latex of a self-reactive acrylonitrile-butadiene-1,3 copolymer. A siloxane compound having the formula $[CH_3Si\ O_3][(CH_3)_2\ Si\ O]_{20}\ ((CH_3)_2\ Si\ CH_2\ O\ [C_2H_4\ O]_{4.3}[C_3H_6\ O]_3\ C_4H_9)_3$ is added as a heat-sensitizer in an amount of 3.0% by weight, calculated as dry matter on the dry latex. The amount of impregnant is about 25g per 100g of web weight. The breaking length of the dry web is 1670 meters; the elongation at break is 19%. After immersion in water of the impregnated web for 24 hours the values measured are 930 meters and 20%, respectively.

EXAMPLE 3

Example 1 is repeated, however, using a latex of a self-reactive vinyl chloride-butylacrylate copolymer instead of the polyacrylate latex.

The latex is frothed to a density of 80g per liter. The breaking length of the dry web is 1710 meters; the elongation at break is 15%. After immersion in water of the impregnated web for 24 hours the values measured are 910 meters and 19% respectively.

EXAMPLE 4

Example 1 is repeated, however with the use of a siloxane-oxyalkylene copolymer having the formula $[C_2H_5(O\ C_3H_6)_7\ O\ O\ C\ N\ H\ C_3H_6]_{0.76}\ (CH_3)_{1.5}\ Si\ O_{0.87}$ in an amount of 0.25% by weight, calculated as dry matter based on the dry latex solids content. Similar results were obtained.

What is claimed is:

1. In the process of manufacturing a fiber web made by the wet method on a paper machine impregnated with a latex binder composition while passing through a screening area of a paper making type machine, the improvement which comprises applying a foamed latex binder composition heat-sensitized to coagulate in the temperature range of from 35° to 95° C as a layer on the top surface of said web, drawing said layer of foamed composition into said web by means of suction, and drying the resulting web and its content of foamed binder composition to coagulate said formed binder composition.

2. The process as claimed in claim 1 wherein said non-woven web has a dry, non-impregnated weight between about 10 and about 400 grams per square meter and the resulting dry impregnated web contains between about 10% and 50% by weight of binder calculated on said dry web weight.

3. The process as claimed in claim 1 wherein said latex binder composition contains a self-reactive poly (ethyl acrylate) latex and from about 0.05% to about 3% by weight, calculated as dry matter on the dry weight of latex, of a siloxane oxyalkylene block copolymer as a heat sensitizer, and coagulates at a temperature in the range of 35°–65° C.

* * * * *